US008191945B2

(12) United States Patent
Compton

(10) Patent No.: US 8,191,945 B2
(45) Date of Patent: Jun. 5, 2012

(54) BALL RETRIEVING APPARATUS

(76) Inventor: Michael Lynn Compton, Tampa, FL (US)

( * ) Notice: Subject to any disclaimer, the term of this patent is extended or adjusted under 35 U.S.C. 154(b) by 1238 days.

(21) Appl. No.: 11/985,227

(22) Filed: Nov. 14, 2007

(65) Prior Publication Data

US 2008/0185855 A1 Aug. 7, 2008

Related U.S. Application Data

(60) Provisional application No. 60/859,643, filed on Nov. 16, 2006.

(51) Int. Cl.
*A63B 47/02* (2006.01)

(52) U.S. Cl. ..... 294/19.2

(58) Field of Classification Search ..... 294/19.2; 473/282, 286

See application file for complete search history.

(56) References Cited

U.S. PATENT DOCUMENTS 3,901,545 A * 8/1975 Shott ..... 294/19.2
4,063,769 A 12/1977 Zimmer
4,522,438 A 6/1985 Logue
5,060,996 A 10/1991 Garnes
5,188,410 A * 2/1993 Summers ..... 294/19.2
5,395,146 A 3/1995 Liu et al.
5,476,297 A 12/1995 Lombard
5,505,510 A 4/1996 Duncan
D374,697 S 10/1996 McKnight
5,634,680 A * 6/1997 Green ..... 294/19.2
5,639,133 A 6/1997 Mote
5,755,632 A * 5/1998 Eddy ..... 473/460
D411,278 S 6/1999 Sammons et al.
5,988,716 A * 11/1999 Liao ..... 294/19.2
6,050,625 A * 4/2000 Nisbet ..... 294/19.2
6,719,340 B2 * 4/2004 Imig ..... 294/19.2
2002/0117870 A1 8/2002 Cash

* cited by examiner

*Primary Examiner* — Paul T Chin
(74) *Attorney, Agent, or Firm* — The Compton Law Firm, P.C.; Scott D. Compton

(57) ABSTRACT

A ball retrieving apparatus configured to receive and retain one or more altering balls from a surface. The ball retrieving apparatus comprises a housing including a first end for receiving one or more altering balls from a surface and a second end for dispensing the one or more altering balls from the housing. The ball retrieving apparatus also comprises a retention member releasably attached to the first end, said retention member comprising (a) one or more clips disposed along the first end of the housing; and (b) a displacement member surrounding the housing and at least part of the one or more clips; the displacement member being configured to regulate the displacement of the one or more clips as a ball is received from said surface into said housing.

14 Claims, 11 Drawing Sheets

BALL RETRIEVING APPARATUS

CROSS-REFERENCE TO RELATED APPLICATIONS

The application is entitled to the benefit of the filing date of the prior-filed provisional application No. 60/859,643, filed on Nov. 16, 2006.

STATEMENT REGARDING FEDERALLY SPONSORED RESEARCH OR DEVELOPMENT

Not applicable.

FIELD OF THE APPLICATION

The application relates to an apparatus for retrieving balls and other spherical objects from a surface.

BACKGROUND

Various devices exist for retrieving balls from a surface. Typical devices include hand held tubular structures that receive balls at an open end and then retain the balls within the tubular structure and/or a bag attached at an opposite end of the tubular structure. Typically, these tubular structures are equipped with a one-way retention device at the open end for allowing balls to enter the tubular structure but not exit out from the tubular structure past the retention device. Unfortunately, known devices are configured to receive and retain only a particular type of ball, such as a golf ball or tennis ball, which has a particular diameter and weight. These devices do not account for alterations to the diameter and/or weight of particular balls being retrieved repeatably over time.

An apparatus is desired that can retain bails comprising various diameters and weights, as well as retain a particular type of ball as it changes in diameter and/or weight over time.

SUMMARY

The present application is directed to a ball retrieving apparatus comprising: a housing including a first end for receiving one or more balls from a surface and a second end for dispensing said one or more balls from said housing; and a retention member releasably attached to the first end, said retention member comprising (a) one or more clips disposed along the first end of said housing; and (b) a displacement member surrounding the housing and at least part of the one or more clips; said displacement member being configured to regulate the displacement of the one or more clips as a ball is received from said surface into said housing.

The present application is also directed to a ball retrieving apparatus comprising: a tubular housing comprising a ball inlet at a first end and a ball outlet at a second end; and a retention member releasably attached to the first end of said housing, said retention member comprising (a) an anchor clamp; (b) one or more clips attached to said anchor clamp further comprising a first section extending along the outer surface of said housing, and a second section extending radially over the first end of said housing partially obstructing the inlet, said clips configured to displace as a ball is retrieved by the apparatus; and (c) an adjustable clamp surrounding said housing and at least part of the first section of the one or more clips; said adjustable clamp being configured to maintain a portion of the first section of the one or more clips against said housing during operation of the apparatus, said portion including said first section from a point under said adjustable clamp to the point of attachment of said first section to said anchor clamp.

The present application is also directed to a method of retrieving and retaining one or more altering balls from a surface, the method comprising the following steps: providing a ball retrieving apparatus comprising (1) a housing comprising a first end for receiving one or more balls and a second end for dispensing one or more balls; and (2) a retention member attached to the first end of the housing, the retention member comprising (a) one or more clips disposed along the first end of the housing; and (b) a displacement member surrounding the housing and at least part of the one or more clips, the displacement member being located at a first position; retrieving one or more balls from a surface into the housing at a first moment, the one or more balls comprising initial dimensions; adjusting the displacement member from the first position surrounding the one or more clips to at least a second position surrounding the one or more clips; and retrieving the one or more balls from a surface into the housing at a second moment, wherein the one or more balls have altered since the first moment.

BRIEF DESCRIPTION

Figure 1:
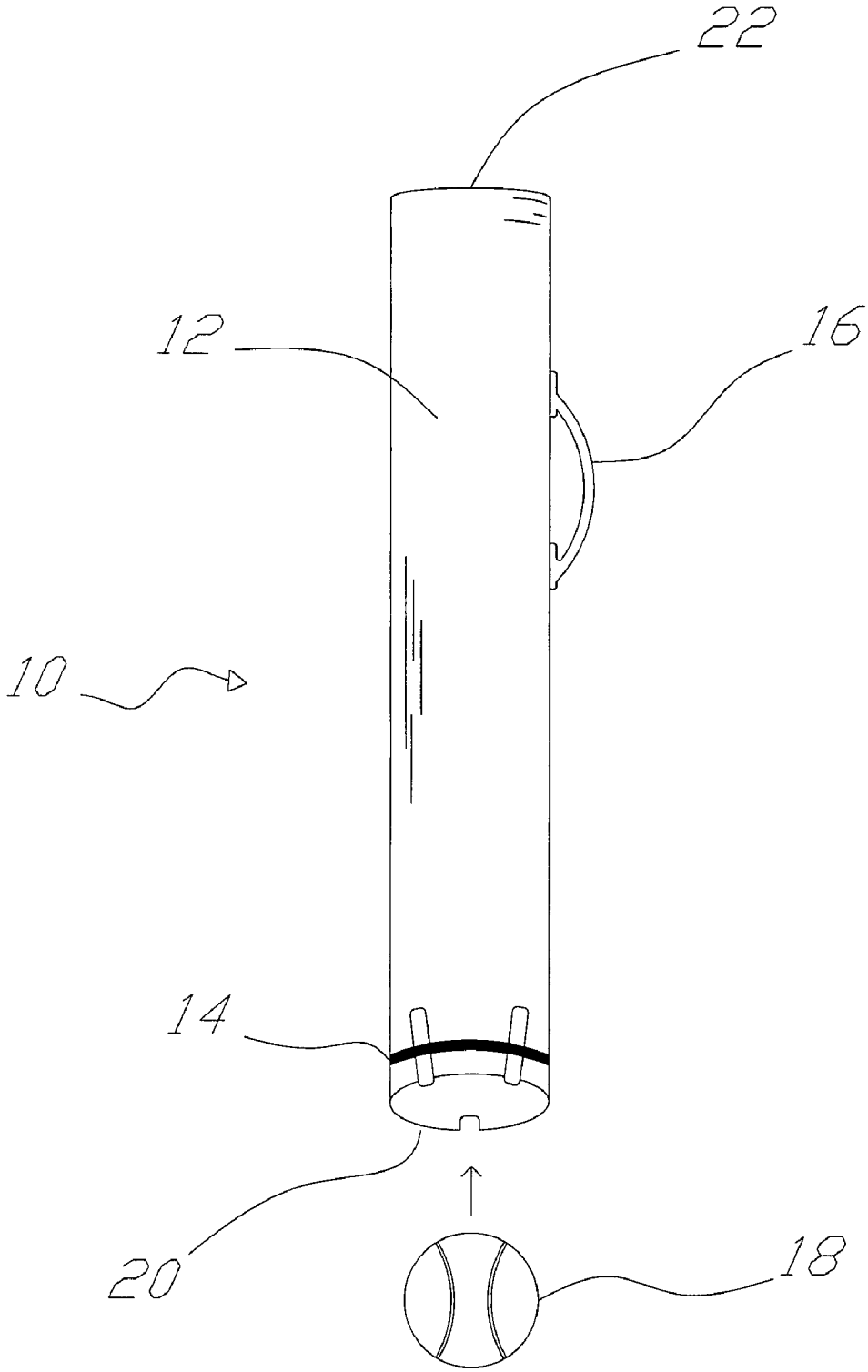
FIG. 1 illustrates a side view of an embodiment of the apparatus.

It has been discovered that a ball retrieving apparatus, including a housing and an adaptable retention member, can be configured to receive and retain balls having various diameters and weights. It has also been discovered that a ball retrieving apparatus, including a housing and an adaptable retention member, can be configured to receive and retain one or more balls of a particular type as the diameter and/or weight of the particular ball(s) change over time. Heretofore, such a desirable achievement has not been considered possible, and accordingly, the ball retrieving apparatus of this invention measures up to the dignity of patentability and therefore represents a patentable concept.

As used herein, the term "ball" is defined as a sphere or sphere like object that is either perfectly symmetrical or substantially symmetrical. A ball as used herein may or may not include spherical objects related to athletics, sport or games. The phrase "particular ball(s)" refers to one or more specific balls of a defined type, such as a baseball, tennis ball, golf ball, etc. The phrase "altering diameter" and like phrases herein refers to either the increase or decrease in diameter of one or more particular balls over a period of time. The phrase "altering weight" refers to either the increase or decrease in weight of one or more particular balls over a period of time. Thus, the terms "alter", "altering" and the like herein refer to the increase/decrease in diameter and/or weight of one or more particular balls over time, i.e., the change in diameter and/or weight of a particular ball in comparison to the ball's initial dimensions as a result of use of the ball over time. Herein, the term "retrieve" may be used interchangeably with the terms receive, gather, and collect to mean the transfer of a ball from a surface to the interior of the housing of the ball retrieving apparatus. Herein, "surface" refers to the ground, floor or other surface, i.e., table, on which one or more balls may be located. Herein, "grass surface" includes, but is not necessarily limited to, a lawn, athletic field, or other surface comprising grass (whether natural or artificial). The grass can be comprised of any length and thickness, however, a common grass surface as described herein is of kind and length typical as used in connection with natural grass athletic surfaces. The term "retrieving end" refers to the end of the housing that is configured to receive one or more balls from a surface and retain the one or more balls within the housing. Reference to a ball moving across a surface means a ball rolling across a surface, bouncing across a surface or sliding across a surface. Herein, "baseball" refers to a regulation baseball as defined by Major League Baseball Rule 1.09 as of the date of this application: "the ball shall be a sphere formed by yarn wound around a small core of cork, rubber or similar material, covered with two stripes of white horsehide or cowhide, tightly stitched together. It shall weigh not less than five nor more than 5¼ ounces avoirdupois and measure not less than nine nor more than 9¼ inches in circumference." Note: five ounces is equal to about 141.75 grams; 5¼ ounces is equal to about 148.83 grams; nine inches is equal to about 22.86 cm; and 9¼ inches is equal to about 23.50 cm.

In one aspect, the present application relates to a ball retrieving apparatus configured to receive one or more balls at a first retrieving end and configured to discharge the one or more balls at a second dispensing end.

In another aspect, the present application relates to a ball retrieving apparatus configured to receive and retain balls that alter in diameter and/or weight over time.

In another aspect, the present application relates to a ball retrieving apparatus configured to receive and retain a plurality of balls comprising various diameters and/or various weights.

In yet another aspect, the present application relates to a ball retrieving apparatus configured to be held by a user at an angle from about 0° to about 90° relative to a surface when receiving one or more balls from the surface.

In still another aspect, the present application relates to a ball retrieving apparatus that can be positioned vertically (i.e., stood substantially upright) on a substantially flat surface and left unattended either empty or when containing one or more balls.

In another aspect, the present application relates to a ball retrieving apparatus that can be positioned vertically (i.e., stood substantially upright) on a substantially flat grass surface and left unattended either empty or when containing one or more balls.

In another aspect, the present application relates to a ball retrieving apparatus wherein the designated retrieving end of the apparatus can alternate between the first end and the second end of the apparatus.

In another aspect, the present application relates to a ball retrieving apparatus wherein both the first end and the second end of the apparatus can be configured as retrieving ends simultaneously.

In another aspect, the present application relates to a ball retrieving apparatus wherein both the first end and the second end of the apparatus can be configured as retrieving ends simultaneously, and wherein the first end of the apparatus can be configured to receive balls of a particular diameter and/or weight, and the second end of the apparatus can be configured to receive balls of a different diameter and/or weight than the balls being received at the first end.

In another aspect, the present application relates to a ball retrieving apparatus configured to act as a portable storage container for one or more balls.

In another aspect, the present application relates to a ball retrieving apparatus configured to act as a continuous feed system for one or more balls from the apparatus to a machine for propelling balls, such as a baseball pitching machine, tennis ball machine and the like.

In another aspect, the present application relates to a ball retrieving apparatus configured to be held by a user's two hands, wherein each hand is placed at a different point along the length of the apparatus during operation of the apparatus.

In another aspect, the present application relates to a ball retrieving apparatus configured to receive a ball moving across a surface into the apparatus.

In another aspect, the present application relates to a ball retrieving apparatus including a capacity determination means for establishing how full the apparatus is at any given time during operation of the apparatus.

In another aspect, the present application relates to a ball retrieving apparatus including a clip displacement means for determining the level of resistance placed on a ball while being received into the apparatus.

In still another aspect, the present application relates to a ball retrieving apparatus that may be configured to initially receive previously unused baseballs of like dimensions into the apparatus without marring the surface of the balls and then later be adjusted to receive the same balls over time as the balls change in diameter and/or weight.

In still another aspect, the present application relates to a ball retrieving apparatus configured to receive a hose or other tube like device at the dispensing end of the apparatus for transporting received balls from the apparatus out through an opposing end of the hose.

In still another aspect, the present application relates to a ball retrieving apparatus comprising a retrieving end having a particular width and a dispensing end having a width different from the retrieving end.

The ball retrieving apparatus (hereafter referred to as the "ball retriever") according to the present application will be described in more detail with reference to the embodiments illustrated in the drawings. The drawings are illustrative only, and are not to be construed as limiting the invention, which is defined in the claims.

The Ball Retriever

The Figures of the drawings, and particularly FIG. 1, disclose a ball retriever 10 comprising at least a housing 12 and a retention member 14 attached to a first end of the housing 12. Optionally, the ball retriever 10 may further comprise a handle 16 attached to the side of the housing 12 that is configured to be grasped by a user for carrying and/or maneuvering the ball retriever 10 during operation.

Suitably, the housing 12 is defined by a hollow shaft and comprises at least inlet 20, i.e., a retrieving end, and an outlet 22, i.e., a dispensing end. In one embodiment, the housing 12 may be tubular. In another embodiment, the housing 12 may comprise a cylindrical inner surface and a multi-sided outer surface. In addition, the housing 12 may comprise multi-sided inner and outer surfaces.

Suitably, the length and inner width of the housing 12 may vary based on the number of balls 18 of a particular diameter to be retrieved and retained within the housing 12. Preferably, the housing 12 comprises a length that allows a user to retrieve one or more balls 18 from a surface without the user having to bend at the knees and/or waist during operation of the ball retriever 10. In one embodiment, the housing 12 comprises a length from about four feet up to about six feet (from about 1.22 meters up to about 1.83 meters). In a particularly advantageous embodiment, the housing 12 comprises a length of about five feet (about 1.52 meters). For example, a housing 12 of about five (5) feet in length is suitably configured to retain up to about twenty-two (22) baseballs. In addition, an extension member may be fastened at the second end of the housing 12 thereby increasing the length of the ball retriever 10 in order to receive and retain additional balls within the ball retriever 10.

It is contemplated herein that the ball retriever 10 may be built to scale in order to receive and retain balls 18 of any particular diameter and weight. Suitably, the ball retriever 10 may be configured to receive and retain one type of athletic ball or a plurality of types of athletic balls simultaneously. Suitable athletic balls include but are not necessarily limited to lawns balls such as croquet balls and bocce balls, baseballs, softballs, tennis balls, racquet balls, cricket balls, golf balls, and combinations thereof. Although the ball retriever 10 may be configured to receive and retain balls having a diameter greater than the diameters of the balls listed above, a ball retriever 10 configured to retrieve balls such balls may be difficult for a user to manually operate.

Suitably, the minimum inner width of the housing 12 is configured for retrieving and retaining the largest diameter ball 18 contemplated by the user. Although not necessarily limited to a particular inner diameter, a tubular housing 12 suitably comprises a uniform inner diameter up to about four inches (about 10.2 cm). In an embodiment configured to receive and retain baseballs, the housing 12 suitably comprises a uniform inner diameter of about three inches (about 7.62 cm).

In another embodiment, the housing 12 may comprise a non-uniform inner width wherein the inner width increases from inlet 20 to a predetermined point along the length of housing 12. In another embodiment, the housing 12 may comprise a non-uniform inner width wherein the inner width increases along the length of housing 12 from inlet 20 to outlet 22.

The housing 12 may also comprise any wall thickness, however, a wall thickness up to about 3/16 inch is suitable for most manual applications contemplated herein. In a particularly advantageous embodiment, the housing 12 wall thickness is about 1/8 inch (about 0.32 cm). In addition, the outer diameter of the housing 12 is not necessarily limited by the inner diameter of housing 12. Suitably, the outer diameter of the housing 12 is up to about 4 1/4 inches (about 10.8 cm). In an embodiment wherein the housing 12 comprises an inner diameter of about 3 inches (about 7.62 cm), and a wall thickness of about 1/8 inches (about 0.32 cm), the housing 12 comprises an outer diameter of about 3 1/4 inches (about 8.26 cm). In addition, the weight of the housing 12 is dependent on the length and wall thickness of housing 12, as well as the material(s) used to construct the housing 12.

The housing 12 may be constructed of any material durable enough to receive one or more balls from a surface and retain the one or more balls 18 within the housing 12. In particular, the housing 12 may be constructed of materials including but not necessarily limited to those materials resistant to chipping, cracking, excessive bending and reshaping as a result of ozone, weathering, heat, moisture, other outside mechanical and chemical influences, as well as various impacts and other loads placed on the housing 12. Likewise, the housing 12 may comprise any color or combination of colors, or in the alternative, the housing 12 may be transparent and translucent depending on individual preferences and needs.

Suitable materials include but are not necessarily limited to metals, plastics, rubbers, woods, fiberglass, plexiglass, filled composite materials, and combinations thereof. Suitable plastics include, but are not necessarily limited to vinyl polymers and polyvinyl chloride (PVC). Suitably metals include, but are not necessarily limited to aluminum, steel and titanium. In one suitable embodiment, the housing 12 may be comprised of PVC. In another suitable embodiment, the housing 12 may be comprised of vinyl polymer. In another suitable embodiment, the housing 12 may be comprised of aluminum. In addition, the housing 12 may comprise one or more apertures or slits in the housing wall effective to lessen the overall weight of the housing 12 as desired. One or more apertures or slits may also serve as the capacity determination means of the ball retriever 10—allowing a user to view the inside of the housing 12.

In a simplified embodiment of the ball retriever 10, the one or more retrieved balls 18 may be dispensed from the housing 12 via outlet 22 by simply orienting the housing 12 outlet down. For example, retrieved balls 18 may be transferred from the ball retriever 10 to another storage container such as a bucket, bag, etc. It is also contemplated that the ball retriever 10 may itself serve as a storage container for one or more retrieved balls 18. In addition, the ball retriever 10 may comprise a sealing means for sealing the retrieved balls 18 within the housing 12. For example, a releasable cap may be sealably attached at either or both of the first and second ends of the housing 12 during storage of the ball retriever 10 thereby sealing the balls 18 against moisture and other environmental influences.

With further reference to FIG. 1, the ball retriever 10 suitably comprises at least one retention member 14 attached at or near the inlet 20 of the housing 12. Suitably, the retention member 14 is configured to (1) allow one or more balls to enter the housing 12 through the inlet 20 past the retention member 14 and (2) maintain the one or more balls within housing 12 without passing beyond the retention member 14.

Figure 2:
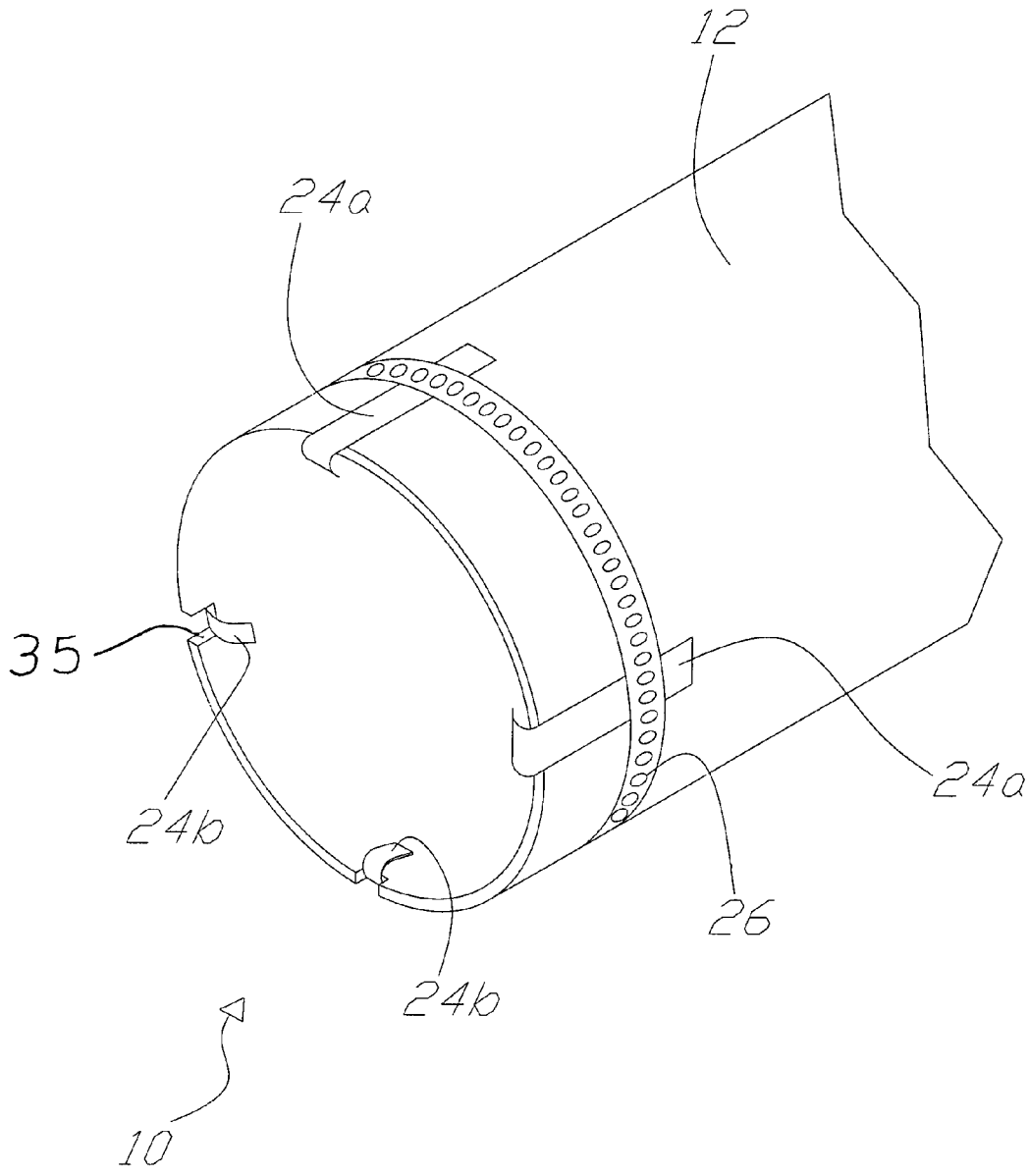
FIG. 2 illustrates a perspective view of a first end of an embodiment of the apparatus including a retention member attached thereto.

With particular attention to FIG. 2, the retention member 14 suitably comprises at least one or more clips 24 and one or more displacement members 26. In one embodiment, the one or more clips 24 may be disposed along a first retrieving end of the housing 12 wherein (a) a first section 24*a* of each clip suitably extends along the outer surface of the housing 12 parallel to the central axis of the housing 12, and wherein (b) a second section 24*b* of each clip suitably extends over the inlet 20 of the housing 12 in a manner effective to at least partially obstruct the inlet 20 during operation of the ball retriever 10. Although not necessarily limited to a particular length, the second section 24*b* of each clip suitably comprises a length effective for the equator of ball 18 to pass the distal end of each second section 24*b* as the ball 18 passes from a surface into the housing 12.

Figure 4A:
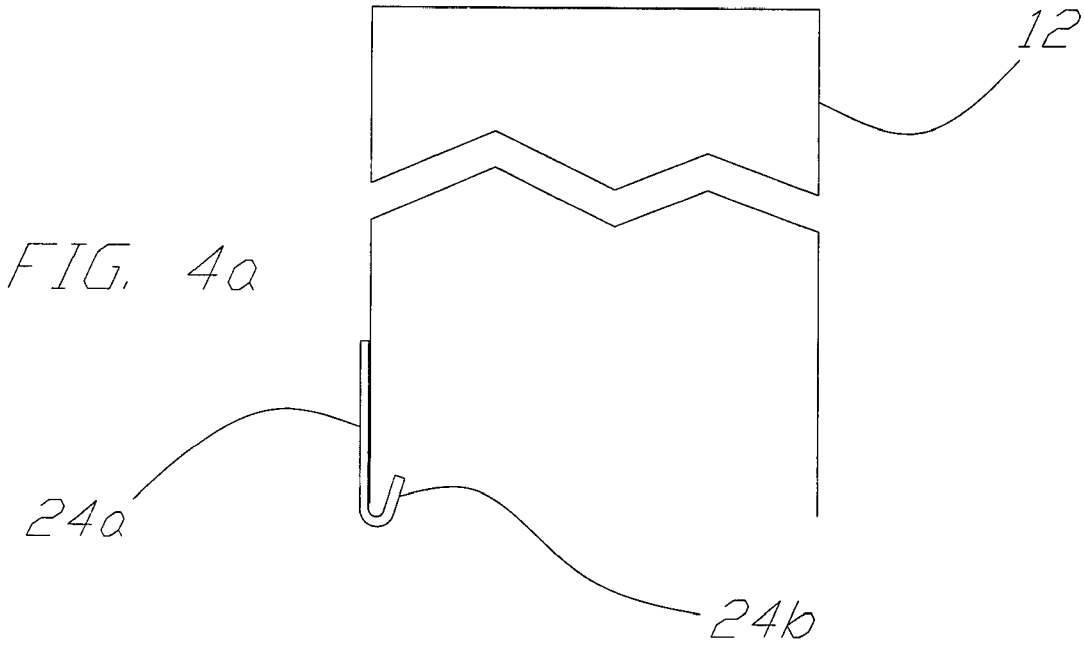
FIG. 4*a* illustrates a side view of a clip attached at a first end of an embodiment of the housing wherein the clip is set in a first retention position.
Figure 4B:
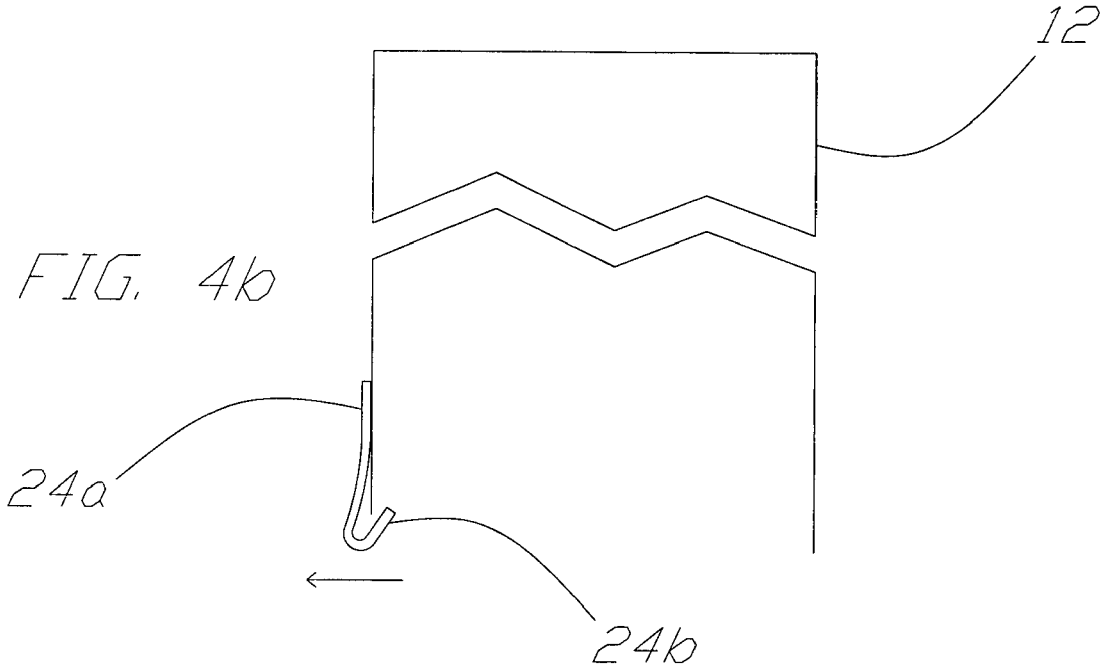
FIG. 4*b* illustrates a side view of a clip attached at a first end of an embodiment of the housing wherein the clip is set in a second retrieving position.

At most, the first section 24*a* of the one or more clips may extend up to about the length of the housing 12, while the second section 24*b* of the one or more clips may extend the inner diameter of the housing 12 at inlet 20. As illustrated in FIGS. 4*a* and 4*b*, each first section 24*a* suitably extends along the outer wall of the housing 12 a distance effective for the displacement of the second section 24*b* of each clip from a first retention position obstructing part of the inlet 20 to a second retrieving position wherein the second section 24*b* is displaced toward the inner wall of the housing 12 a distance effective for a ball 18 to pass the second sections 24*b* into the housing 12. Thus, the length of the second sections 24*b* of each clip may be determined, at least in part, by (1) the inner and outer widths of the housing 12, (2) the diameter of the ball 18 to be retrieved and retained within the housing 12, and/or (3) the weight of the ball 18 to be retrieved and retained within housing 12.

Figure 3A:
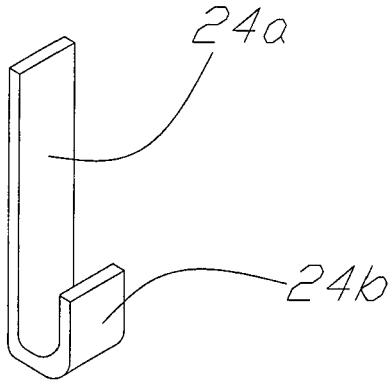
FIG. 3*a* illustrates a perspective view of a first embodiment of a clip.
Figure 3B:
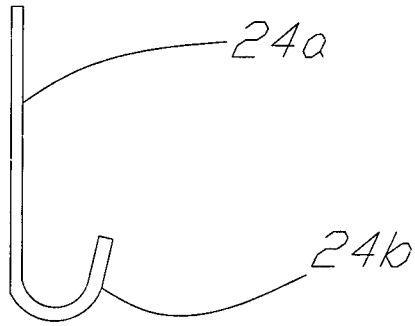
FIG. 3*b* illustrates a side view of the first embodiment of the clip.
Figure 3C:
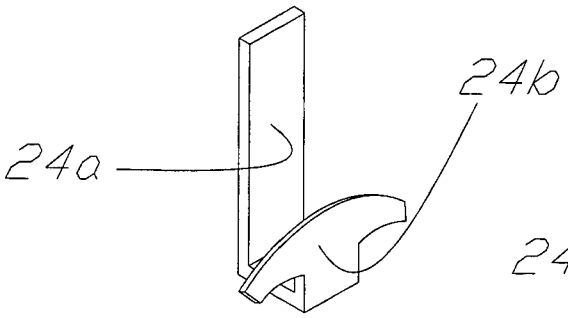
FIG. 3*c* illustrates a perspective view of a second embodiment of a clip.
Figure 3D:
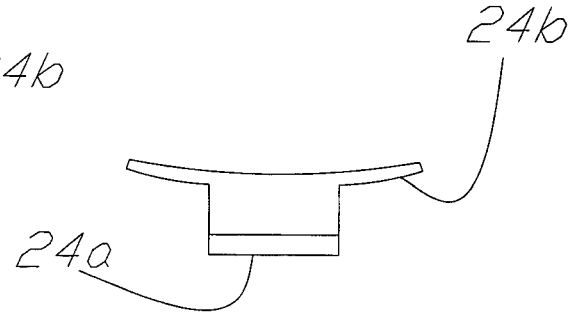
FIG. 3*d* illustrates a top view of the second embodiment of the clip.

With reference to FIGS. 3*a*-3*d*, the clips 24 of the retention member 14 may comprise any configuration effective for retrieving and retaining balls within the housing 12. In addition, the clips 24 may be configured to displace or travel a predetermined distance subject to the location of the displacement member 26 surrounding the first section 24*a* of each clip 24, i.e., the point of compression of the displacement member 26 along the length of each first section 24*a* of the one or more clips 24. In an embodiment as shown in FIGS. 3*a* and 3*b*, the clips 24 may comprise elongated rectangular members including a first section 24*a* and a bent second section 24*b*. In another embodiment, the one or more clips 24 may comprise a second section 24*b* wider at a distal end than the width of its first section 24*a*—as shown in FIGS. 3*c* and 3*d*. In addition, the clips 24 may be constructed of a one piece material. In the alternative, the clips 24 may be constructed of two or more separate pieces of materials coupled together.

Suitably, the clips 24 comprise "J-shaped" members configured to be displaced from a first retention position (as shown in FIG. 4*a*) to a second retrieving position (as shown in FIG. 4*b*). Herein, a "first retention position" is defined as the resting position of the one or more clips 24 wherein the second section 24*b* of the one or more clips 24 at least partially obstructs inlet 20—thereby preventing balls 18 from exiting the housing 12 through inlet 20. A "second retrieving position" is herein defined as the displaced position of a clip 24 from the first retention position toward the inside wall of the housing 12. The amount of displacement of any one clip 24 may be determined, at least in part, by the length of the second section 24*b*, the diameter of the ball 18 received through the inlet 20 of the housing 12, and the position or compression point of the displacement member 26 against the one or more clips 24. Suitably, the clips 24 comprise a bend forming an angle from slightly greater than 0° up to about 90° between the distal end of the first section 24*a* and the distal end of the second section 24*b*. In a particularly advantageous embodiment, the distal end of the first section 24*a* and the distal end of the second section 24*b* are about 30° to each other.

Figure 5A:
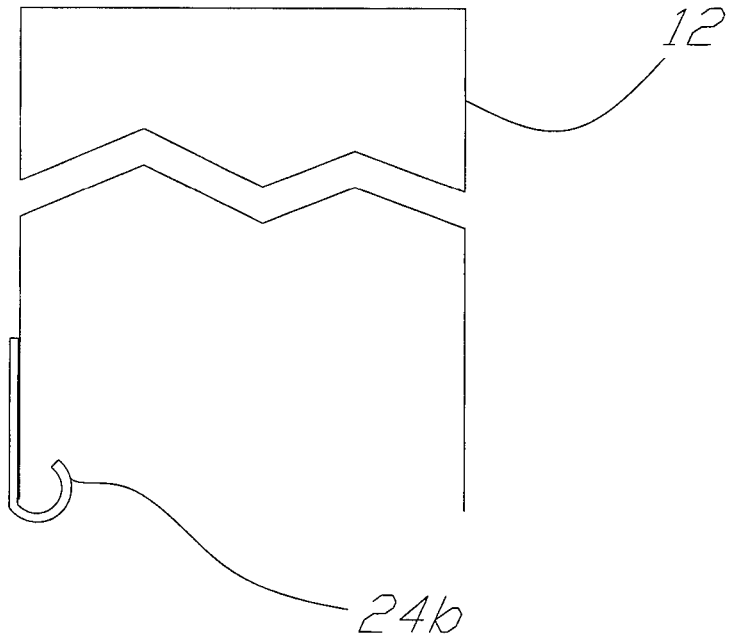
FIG. 5*a* illustrates a side view of a clip attached at a first end of an embodiment of the housing, the clip comprising a first curved configuration.
Figure 5B:
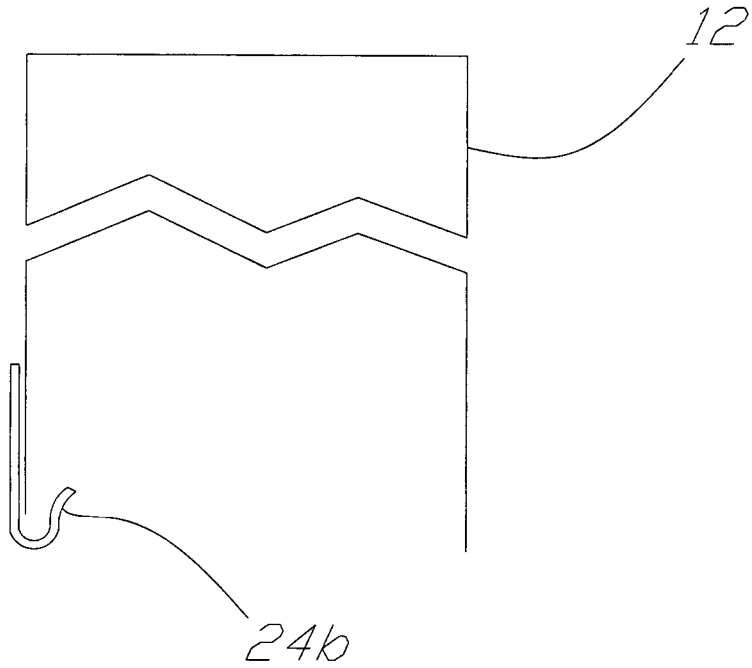
FIG. 5*b* illustrates a side view of a clip attached at a first end of an embodiment of the housing, the clip comprising a second curved configuration.

As further illustrated in FIG. 4*a*, the clip 24 may be configured so that the length of the first section 24*a* abuts the outer surface of the housing 12. In another embodiment, the first section 24 may abut at least part of the surface of the outer wall of the housing 12. In addition, the second section 24*b* may include a substantially flat or straight configuration—as shown in FIG. 4*a*. In the alternative, the second section 24*b* may comprise a curved configuration as shown in FIGS. 5*a* and 5*b*. It is also contemplated that the second section 24*b* may comprise other configurations including, for example, a multiple bend or multiple curve configuration.

The clips 24 are not necessarily limited to a particular width, except that the maximum desired width of the second section 24*b* of any one clip 24 is limited, in part, to (a) the inner width of the housing 12, (b) the total number of clips 24 to be used, and (c) the desired first retention position of the clips 24. In an embodiment including abutting first sections 24*a* around the housing 12, the maximum number of clips 24 used may be determined by the width of each clip 24 at the first section 24*a*, as well as the inner and outer diameters of the housing 12. In still another embodiment, first and second sections 24*a*, 24*b* of adjacent clips may overlap if desired.

In one particularly advantageous embodiment of the ball retriever 10 configured to retrieve baseballs from a surface, the ball retriever 10 suitably comprises (a) a tubular housing 12 and (b) a retention member 14 including clips 24 having first and second sections 24*a*, 24*b* of equal width. Suitably, the retention member 14 comprises three to five clips 24—each clip 24 comprising a width about 1/20 the circumference of the outer wall of the housing 12. For example, in an embodiment comprising a tubular housing 12 having an outer circumference of about 10.20 inches (about 25.93 cm) and four clips 24 having first and second sections 24*a*, 24*b* of equal width, each clip 24 suitably comprises a width of about ½ inch (about 1.27 cm).

In another particularly advantageous embodiment of the ball retriever 10 comprising a tubular housing 12 having an inner diameter of about 2.00 inches (about 5.00 cm) configured to receive and retain balls having a diameter of about 1.68 inches (about 4.27 cm), each of the four clips 24 comprises a width from about 0.31 inches (about 8.00 mm) to about 0.47 (about 12.0 mm); the first section 24*a* of the clips 24 comprises a length of about 2.00 inches or more (about 5 cm or more), and the second section 24*b* of the clips 24 comprises a length of about ⅜ inches or more (about 1.00 cm or more). In still another particularly advantageous embodiment of the ball retriever 10 configured to receive and retain balls having a diameter of about 3.82 inches (about 9.70 cm), the first section 24*a* of the clips 24 comprises a length from about 2½ inches to about 3½ inches (from about 6.35 cm to about 8.89 cm), and the second section 24*b* of the clips 24 comprises a length from about ½ inches to about ⅝ inches (from about 1.27 cm to about 1.59 cm).

In another embodiment of the ball retriever 10 configured to receive and retain balls having a diameter from about 2.86 inches to about 2.95 inches (from about 7.26 cm to about 7.50 cm) wherein the housing 12 ranges in length from about four feet to about six feet, the length of first section 24*a* of each clip is suitably from about 2½ inches to about 3½ inches (from about 6.35 cm to about 8.89 cm); and the length of the second section 24*b* is suitably from about ½ inches to about ⅝ inches (from about 1.27 cm to about 1.59 cm). Suitable clips 24 comprise a thickness from about 0.04 inches (about 0.1 cm) to about 0.20 inches (about 0.5 cm).

In another particularly advantageous embodiment of the ball retriever 10 configured to receive and retain balls having a diameter from about 2.86 inches to about 2.95 inches (from about 7.26 cm to about 7.50 cm) and a weight of about 4 ounces (about 113.40 grams) or more (as detailed in Table 1), the first section 24*a* and second section 24*b* comprise the following parameters:

TABLE 1

| | | |
|---|---|---|
| Length of Housing: | about 5 feet | (about 152 cm) |
| Inner Diameter of Housing: | about 3 inches | (about 7.62 cm) |
| Outer Diameter of Housing: | about 3¼ inches | (about 8.26 cm) |
| Housing wall thickness: | about ⅛ inches | (about 0.32 cm) |
| Length of First section of Clip: | about 2½ inches | (about 6.35 cm) |
| Length of Second section of Clip: | about ½ inch | (about 1.27 cm) |
| Width of Clips (four total): | about ½ inch | (about 1.27 cm) |
| Thickness of Clips: | about 0.08 inches | (about 0.20 cm) |

In one embodiment of the clip 24, the angle between the first section 24*a* and second section 24*b* may be reduced during operation of the ball retriever 10. In a particularly advantageous embodiment, the angle between first section 24*a* and second section 24*b* remains constant during operation of the ball retriever 10. Thus, the one or more clips 24 are suitably constructed from one or more material(s) resilient enough to maintain a constant bend angle of the clips 24 as the clips 24 are displaced from a first retention position (FIG. 4*a*) to a second retrieving position (FIG. 4*b*). Suitable clip materials include, but are not necessarily limited to metals, woods, plastics, rubbers, composite materials, glass, natural stone or rock, leather and combinations thereof. In a particularly advantageous embodiment, the clip 24 is constructed of spring steel.

It is further contemplated herein, that the clip dimensions and materials of construction may be modified as determined by the surface from which balls 18 are being received. For example, a particular clip 24 may be more suited for use in conjunction with a soft surface such as a grass surface, whereas a wholly different clip 24 design may be more suited for use in conjunction with a hard surface such as a concrete surface. In addition, the housing 12 may include one or more cutouts 35 at the first end configured to secure the clips against lateral movement during operation of the ball retriever 10.

Figure 6:
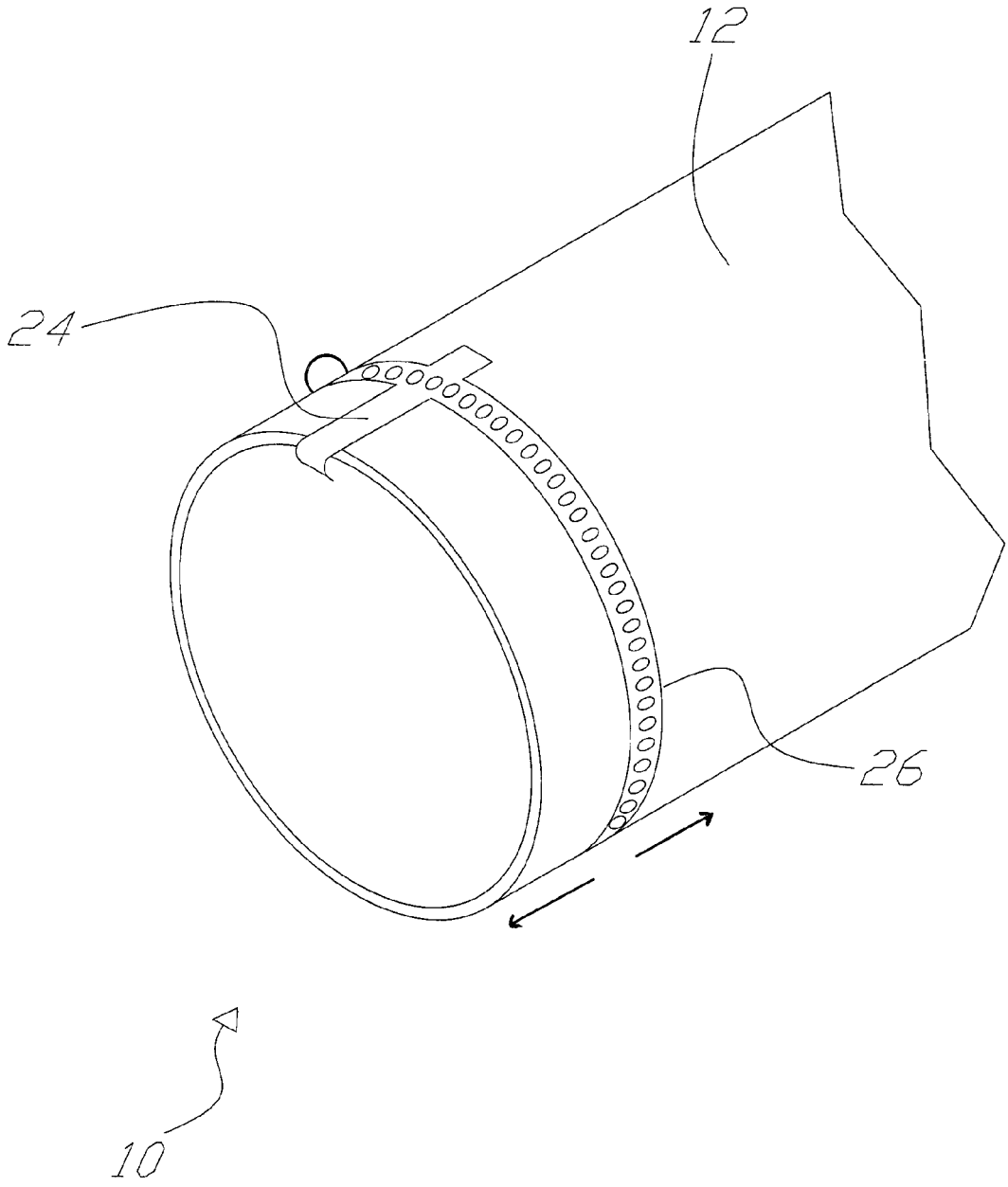
FIG. 6 illustrates a perspective view of a first end of an embodiment of the apparatus including a retention member attached thereto.
Figure 7:
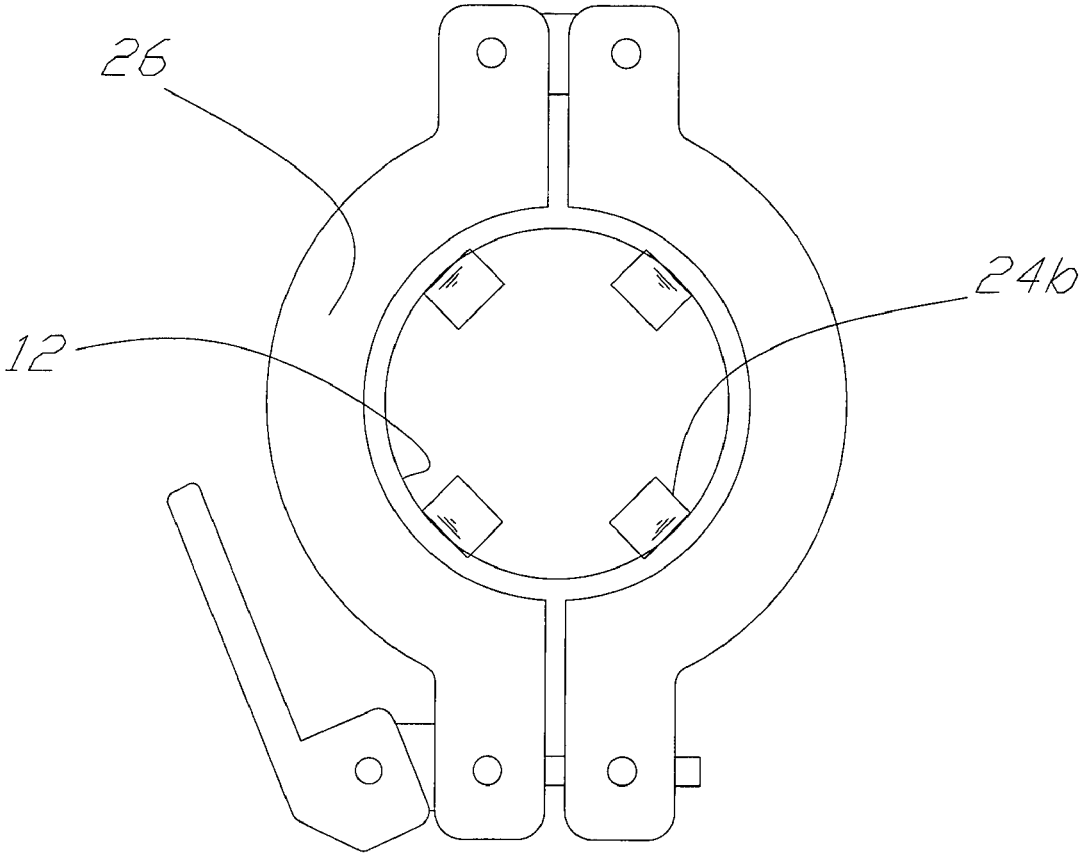
FIG. 7 illustrates an end view of an embodiment of the apparatus including an adjustable lever clamp surrounding the housing and clips of the apparatus.

With particular reference to the displacement member 26, it is herein contemplated that the displacement member 26 may be adjusted along the housing 12 as desired. As FIGS. 2 and 6 illustrate, the displacement member 26 may surround the first section 24*a* of clips 24 at one or more settings in a manner effective to compress at least part of each first section 24*a* against the outer wall of the housing 12. Suitably, the portion of each first section 24*a* that is compressed against the outer wall of housing 12 includes at least the portion of the first section 24*a* in direct contact with the displacement member 26. In one embodiment, the displacement member 26 comprises an adjustable collar type member that surrounds or encircles both the housing 12 and the first section 24*a* of the one or more clips 24. In another embodiment, the displacement member 26 comprises an adjustable hose clamp configured to be adjusted in the direction of the arrows illustrated in FIG. 6. In still another suitable embodiment, the displacement member 26 comprises an adjustable lever clamp—as shown in FIG. 7.

Figure 8:
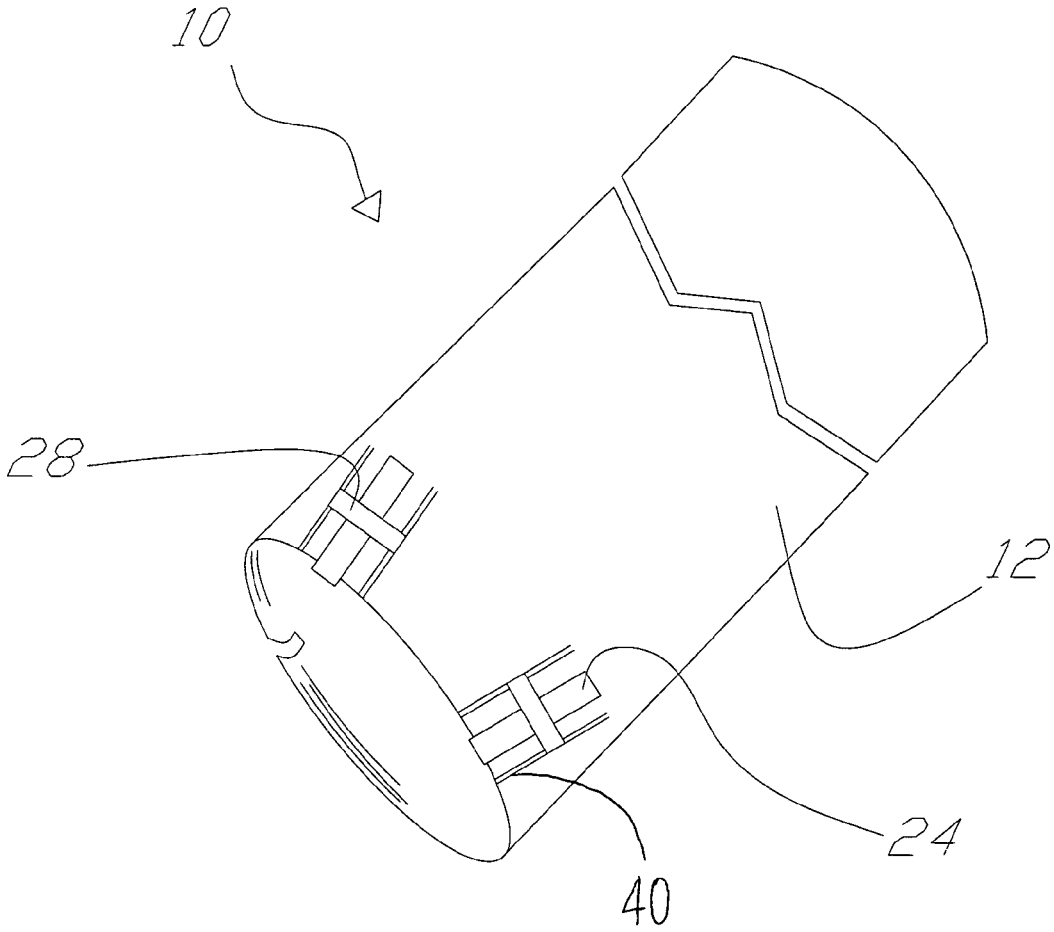
FIG. 8 illustrates a perspective view of a first end of an embodiment of the apparatus including a retention member comprising staple type clips.

In yet another embodiment, as shown in FIG. 8, individual staple type clips 28 may be configured to engage and compress at least part of each first section 24*a* against the outer wall of the housing 12. In this embodiment, each staple type clip 28 may be adjusted along a track 40 up to a length corresponding to the length of the first section 24*a* of a clip 24 and fix in place at a desired point along the length of the first section 24*a*.

Although the displacement member 26 may comprise a width up to about the length of the housing 12, the width of the displacement member 26 is suitably less than the length of the first section 24*a* of the longest clip 24. In a particularly advantageous embodiment, the displacement member 26 comprises a width effective to compress at least a portion of the first section 24*a* against the outer wall of housing 12 as (a) the remaining length of the first section 24*a* extending from about the displacement member 26 to the inlet 20 is configured to displace or travel out from the outer surface of the housing 12, and (b) the remaining length of the first section 24*a* extending from about the displacement member 26 to an attachment point of the first section 24*a* to the housing 12 remains in contact with the outer surface of the housing 12 during operation.

Although not necessarily limited to a particular embodiment, at a minimum the retention member 14 comprises one or more clips 24 independently fastened to the housing 12 near the distal end of each first section 24*a*, and an adjustable displacement member 26 releasably attached to the clips 24 and the housing 12. Suitably, the clips 24 may be coupled to the housing 12 by any means effective for the desired use of the ball retriever 10. For example, the clips may be coupled to the housing 12 via adhesives, screws, rivets, tape and combinations thereof.

Figure 9:
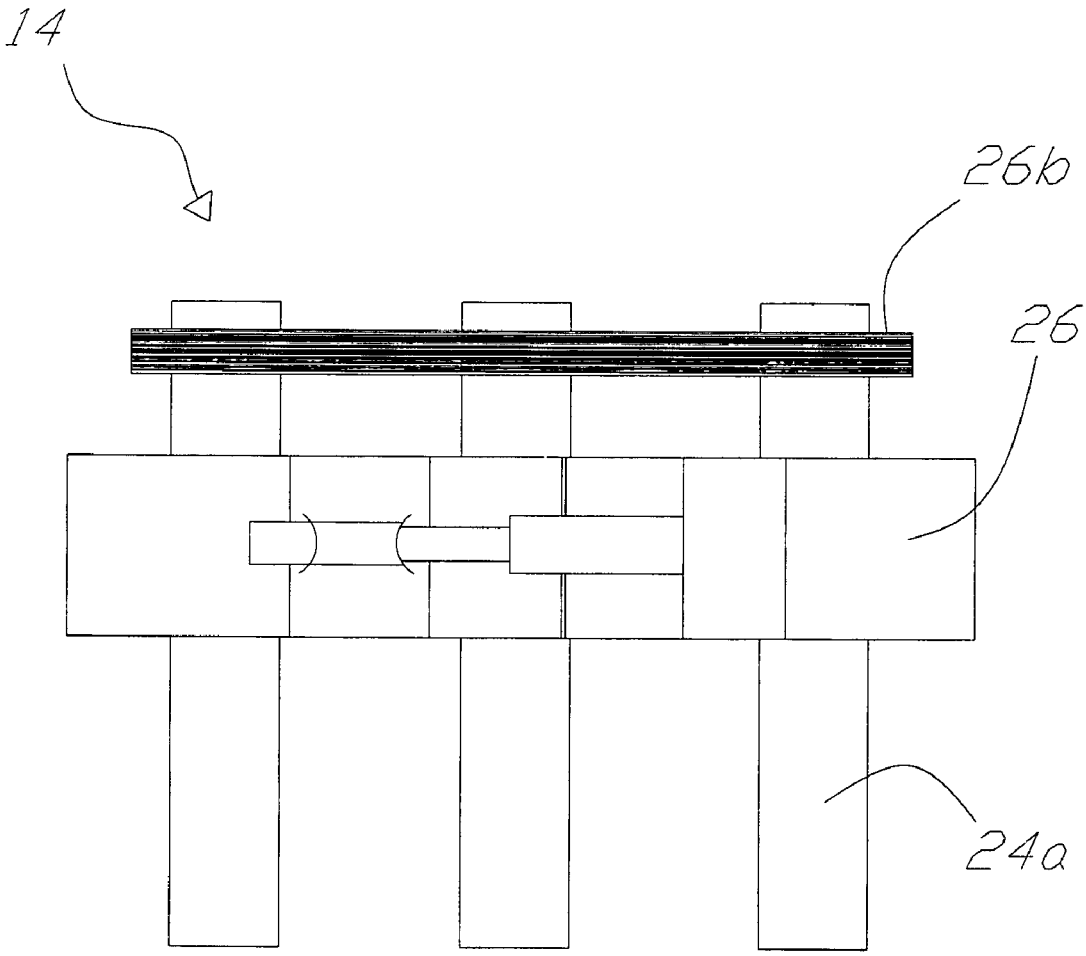
FIG. 9 illustrates a side view of an embodiment of the retention member including an anchor clamp and a displacement member.

In a particularly advantageous embodiment of the retention member 14 as shown in FIG. 9, the retention member 14 comprises a one piece configuration including (1) an anchor clamp 26*b* joined to the distal end of each of the first sections 24*a* of the clips 24, and (2) an adjustable displacement member 26 releasably attached to the clips 24, wherein the displacement member 26 may be configured to adjust at least the length of the first sections 24*a* of the one or more clips 24 (and up to the length of the housing 12 if so desired). In this embodiment, the retention member 14 is releasably attached to the first retrieving end of the housing 12 wherein the anchor clamp 26*b* may be compressed against the housing 12 to secure the retention member 14 to the housing 12. In another embodiment, the anchor clamp 26*b* may be fastened to the housing 12 via screws, rivets, bolts, and combinations thereof.

As FIG. 9 illustrates, the displacement member 26 is configured to compress a portion of the first section 24*a* of each clip against the outside wall of the housing 12. As the clips 24 displace during operation, the first section 24*a* of each clip 24, from about the displacement member 26 to about the anchor clamp 26*b*, remains in contact with the outer surface of the housing 12.

The clips 24 may be either permanently or releasably joined to the anchor clamp 26*b* as desired. For example, the clips 24 may be joined to the anchor clamp 26*b* via welds, rivets, screws, clips, adhesives, bolts, crimps, male/female type fasteners, and combinations thereof. It is also contemplated that the one or more clips may comprise part of the housing 12, thereby extending out from the housing 12 to form first and second sections 24*a*, 24*b*. In case of a clip 24 detaching from either the housing 12 or the anchor clamp 26*b*, the displacement member 26 is configured to maintain the clip 24 against the housing 12—safeguarding against possible loss of the clip 24.

In an embodiment of the ball retriever 10 including a handle 16, it is contemplated that the handle 16 may comprise any configuration effective for a user to grasp, carry and maneuver the ball retriever 10 as desired. In an alternative embodiment, the housing 12 may comprise a contoured outer surface effective for a user to grip, carry and maneuver the ball retriever 10 during operation. The housing 12 may also include a textured outer surface, e.g. dimpled outer surface, effective for a user to grip, carry and maneuver the ball retriever 10 during operation. In still another embodiment, the outer surface of the housing 12 may comprise a rubber gripping section (or other tacky material) effective for a user to grip, carry and maneuver the ball retriever 10 during operation.

Discussion of the Operation of the Ball Retriever

The application is further directed to a method employing the above described ball retriever 10. In a simplified embodiment, the method comprises at least (1) providing a ball retriever 10 configured to receive and retain one or more balls 18 from a surface; (2) applying pressure to a ball 18 at the inlet 20 of the ball retriever 10 to direct the ball 18 past the inlet 20 into the housing 12; and (3) repeating step (2) for additional balls 18 up to the capacity of the ball retriever 10.

Figure 10:
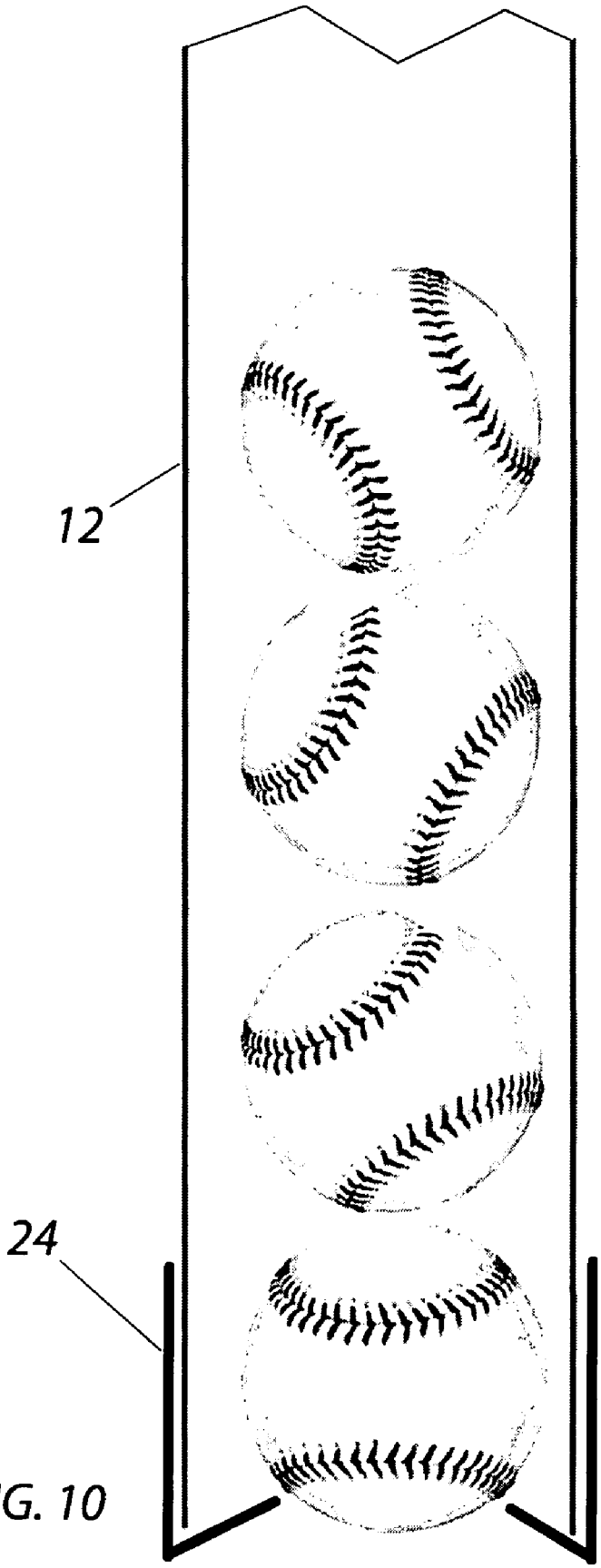
FIG. 10 illustrates a side view of a first end of an embodiment of the apparatus including a plurality of like balls retained within the housing of the apparatus.

In suitable operation, a user holds the ball retriever 10 near a ball 18 located on a surface. With the housing 12 positioned substantially perpendicular to the surface, the user aligns the ball 18 with the inlet 20 of the housing 12. Once aligned, the user applies pressure to the ball 18 wherein the ball 18 contacts at least the second section 24*b* of the clips 24 thereby displacing the second section 24*b* of the clips 24 toward the inner surface of the housing 12. Once each of the second sections 24*b* has been displaced a distance whereby the unobstructed portion of the inlet 20 equals at least the diameter of the ball 18 (i.e., second retrieving position), the ball 18 may then travel past the second section 24*b* of clips 24 into the housing 12. Once the ball 18 travels past the second section 24*b* of clips 24, each of the second sections 24*b* returns to its first retention position. At this point, additional balls 18 may be received and retained within the housing 12 up to the maximum number of balls for which the particular ball retriever 10 is designed to hold. FIG. 10 illustrates a simplified embodiment including a plurality of like balls 18 as retained within a housing 12 by clips 24.

Suitably, the housing 12 is configured whereby a user may hold the housing 12 near a midpoint of the housing 12 with one hand and on or near the outlet 22 with the other hand in a manner effective for the user to retrieve one or more balls 18 from a surface without having to bend at the waist and/or knees. A user may line up the inlet 20 of the ball retriever 10 with a ball 18 located on a surface by looking down the length of the outer surface of the housing 12 from a position where the user's eyes are above or near the outlet 22 of the housing 12. From this position, a user may direct the inlet 20 of the housing 12 toward a ball 18 accurately and quickly, thereby speeding the rate of retrieval of one or more balls 18.

Likewise, since the ball retriever 10 is configured to retrieve balls 18 while being held at an angle from about 0° to about 90° relative to a surface, a ball 18 may be retrieved at a distance away from a user up to the length of the housing 12 plus the arm length of the user (including any additional bending at the waist/knees to further the user's reach toward a ball 18). Thus, one or more balls 18 may be retrieved without a user needlessly approaching balls 18 within such a reach perimeter.

Figure 11:
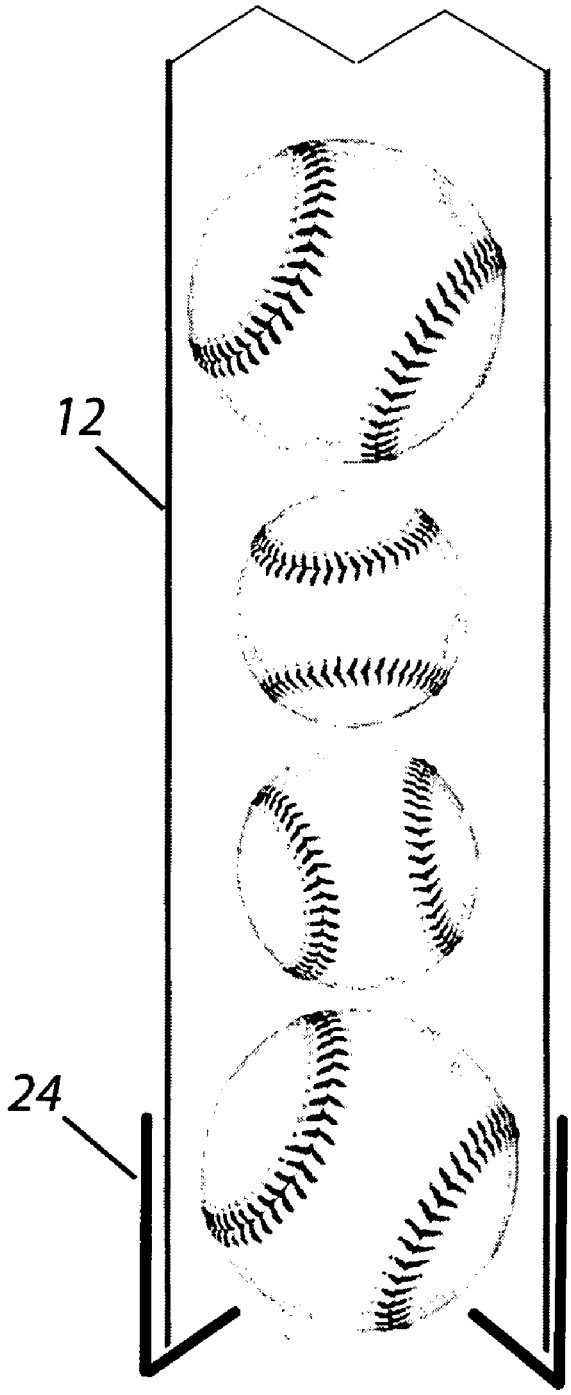
FIG. 11 illustrates a side view of a first end of an embodiment of the apparatus including a plurality of baseballs having various diameters retained within the housing of the apparatus.

With reference now to FIG. 11, a simplified housing 12 and clips 24 are shown retaining a plurality of baseballs having various diameters. With continued use, the outer cover of a baseball is subject to wear, which may lead to a reduction in the diameter of a baseball as the outer cover wears off over time. Thus, it may become necessary to adjust the retention member 14 to receive and retain baseballs (and other balls) as they get smaller over time by decreasing the amount of displacement of the second section 24*b* of the clips 24. For example, a baseball decreasing in diameter over time may travel out of the housing 12 past a retention member 14 that includes a displacement member 26 still set at its initial setting.

Likewise, it may become necessary to adjust the retention member 14 to receive and retain balls, such as baseballs, as the balls get larger over time, i.e., increase in diameter over time. With regard to baseballs, this scenario often occurs when the baseballs become waterlogged, thereby causing the baseballs to swell. Thus, it may become necessary to adjust the retention member 14 to receive and retain baseballs (and other balls) as they get larger over time by increasing the amount of displacement of the second section 24*b* of the clips 24.

In addition, waterlogged baseballs may gain weight, thereby putting additional stress on the clips 24 of the retention member 14 as the baseballs are retained within the housing 12. Thus, the retention member 14 may be adjusted to accommodate not only an increase in diameter, but also any increase in the weight of the balls 18. Thus, by maneuvering the displacement member 26 along the length of the first section of each clip 24, i.e., changing the point of compression of the displacement member 26 against the first section 24*a*, the amount of displacement of the first and second sections of each clip 24 may be adjusted to retain balls 18 as the balls 18 experience alterations in both diameter and weight.

As multiple balls 18 are received and retained within the housing 12, the total stress placed on the retention member 14 increases due to the weight of each additional ball 18 entering the housing 12. Thus, for any particular number of balls 18 and any combination of different types of balls, including balls of varying weights, there exists a retention threshold whereby the configuration of the retention member 14 is effective to retain only a predetermined number of balls within the housing 12 until the most recently received ball 18 exits back out through the inlet 20. For example, a ball retriever 10 having a particular retention member 14 configuration, including a particular displacement member 26 setting, may retain nineteen baseballs within the housing 12 when the ball retriever 10 is set in an upright or vertical position. When attempting to retrieve a twentieth baseball, the twentieth baseball may enter the inlet 20 in like manner as the previous nineteen baseballs but then be subsequently forced out of the housing 12 through the inlet 20 due to the cumulative weight of the twenty baseballs. Thus, the retention threshold of this example is equal to the weight of nineteen baseballs within the housing 12.

Generally, as the point of compression of the displacement member 26 nears the inlet 20 of the housing 12, the amount of displacement of the clips 24 decreases. In other words, there is a direct correlation between the point of compression of the displacement member 26 and the retention threshold of the retention member 14. Thus, an additional feature of the ball retriever 10 may include a clip displacement means characterized by graduation marks placed along the outer surface of the housing 12 effective for aligning the displacement member 26 along the first section 24*a* of the clips 24 at a predetermined retention threshold for a known ball combination to be retained within the housing 12.

As will be understood by those of ordinary skill in the art, and others, many modifications may be made without departing from the spirit and scope of the invention. The embodiments described herein are meant to be illustrative only and should not be taken as limiting the invention, which is defined in the following claims.

I claim:

1. A ball retrieving apparatus comprising:

a housing including a first end for receiving one or more balls from a surface and a second end for dispensing said one or more balls from said housing; and a retention member releasably attached to the first end, said retention member comprising (a) one or more clips disposed along the outer surface of the first end of said housing; and (b) an adjustable displacement member surrounding the housing and at least part of the one or more clips defining a compression point against the one or more clips;

said displacement member being configured to regulate the displacement of the one or more clips as a ball is received from said surface into said housing.

2. The apparatus of claim 1 wherein said displacement member comprises a clamp adjustable up to the length of the housing.

3. The apparatus of claim 1 wherein each of the one or more clips includes a first section and a second section defining an angle, the first section being operationally configured to extend along the outer surface of the housing, the second section being operationally configured to at least partially obstruct the first end of the housing, the angle of one or more clips remaining constant during displacement of the one or more clips.

4. The apparatus of claim 2 wherein said clamp defines a compression point of the one or more clips to the housing.

5. The apparatus of claim 3 wherein a portion of the first section of said one or more clips from about the displacement member to about the distal end of the first section remains in contact with said housing during operation of said apparatus.

6. The apparatus of claim 1 wherein said retention member may attach at either said first end or said second end of the housing.

7. The apparatus of claim 1 comprising three to five clips constructed of spring steel.

8. The apparatus of claim 1 wherein each clip comprises a width about 1/20 the circumference of the outer wall of the housing.

9. The apparatus of claim 1 further comprising a handle attached to said housing.

10. The apparatus of claim 1 wherein said retention member comprises staple type clips configured to engage and compress at least part of each clip against the outer wall of said housing.

11. The apparatus of claim 1 wherein said housing material is plastic.

12. A method of retrieving and retaining one or more altering balls from a surface, the method comprising the following steps:

providing a ball retrieving apparatus comprising (1) a housing comprising a first end for receiving one or more balls and a second end for dispensing one or more balls; and (2) a retention member attached to the first end of said housing, said retention member comprising (a) one or more clips disposed along the outer surface of the first end of said housing; and (b) an adjustable displacement member surrounding the housing and at least part of the one or more clips, said displacement member being located at a first position defining a first compression point against the one or more clips;

retrieving one or more balls from a surface into the housing at a first moment, said one or more balls comprising initial dimensions;

adjusting said displacement member from said first position surrounding the one or more clips to at least a second position surrounding the one or more clips defining a second compression point against the one or more clips; and retrieving the one or more balls from a surface into the housing at a second moment, wherein said one or more balls have altered since said first moment.

13. The method of claim 12, wherein the position of the displacement member surrounding the one or more clips is directly correlated to a retention threshold of the retention member for said one or more balls.

14. The method of claim 12, wherein the one or more balls retrieved from said surface are moving across said surface as the one or more balls are retrieved into the housing.

* * * * *